US008147361B1

(12) United States Patent
Weaver

(10) Patent No.: US 8,147,361 B1
(45) Date of Patent: Apr. 3, 2012

(54) BROADHEAD

(75) Inventor: Zachary T Weaver, Hummelstown, PA (US)

(73) Assignee: Weaver's Outdoor, Inc., Hummelstown, PA (US)

( * ) Notice: Subject to any disclaimer, the term of this patent is extended or adjusted under 35 U.S.C. 154(b) by 0 days.

(21) Appl. No.: 13/276,356

(22) Filed: Oct. 19, 2011

Related U.S. Application Data

(63) Continuation of application No. 13/167,153, filed on Jun. 23, 2011.

(60) Provisional application No. 61/428,001, filed on Dec. 29, 2010.

(51) Int. Cl.
*F42B 6/08* (2006.01)

(52) U.S. Cl. ..... 473/583

(58) Field of Classification Search ..... 473/582, 473/583, 584
See application file for complete search history.

(56) References Cited

U.S. PATENT DOCUMENTS

| | | | | |
|---|---|---|---|---|
| 5,100,143 | A * | 3/1992 | Puckett | 473/583 |
| 5,820,498 | A | 10/1998 | Maleski | |
| 6,200,237 | B1 * | 3/2001 | Barrie | 473/583 |
| 6,217,467 | B1 | 4/2001 | Maleski | |
| 6,270,435 | B1 * | 8/2001 | Sodaro | 473/583 |
| 6,669,586 | B2 | 12/2003 | Barrie et al. | |
| 6,935,976 | B1 | 8/2005 | Grace, Jr. et al. | |
| 7,234,220 | B1 | 6/2007 | Grace, Jr. | |
| 8,016,704 | B1 | 9/2011 | Vandewater | |
| 2009/0203477 | A1 | 8/2009 | Mizek et al. | |

* cited by examiner

*Primary Examiner* — John Ricci
(74) *Attorney, Agent, or Firm* — Hooker & Habib, P.C.

(57) ABSTRACT

A broadhead with expandable front pivot cutting blades has the cutting blades connected to the broadhead by low-friction rotary connections. The connections reduce frictional forces during outward rotation of the blades and permit locked blade deployment before the blades hit the target.

16 Claims, 4 Drawing Sheets

BROADHEAD

BACKGROUND OF THE INVENTION

Conventional broadheads have expandable front pivot cutting blades. The blades are in collapsed positions in the broadhead ferrule during flight and, upon impact, automatically deploy out from the ferrule to locked impact positions. The blades must rapidly rotate outwardly from the collapsed to the impact positions during the short interval between when the ferrule first contacts the target and when the blades contact the target.

Conventional broadheads have rotary connections between the blades and the ferrule. These connections have high frictional forces when the blades rotate and deploy upon impact. The friction slows outward rotation of the blades and can prevent the blades from locked deployment before the blades come into contact with the target. If the blades are not locked in the deployed position, the impact of the broadhead on the target is undesirably reduced.

Thus, there is a need for an improved broadhead having expandable front pivot cutting blades where, during impact of the broadhead on a target, the blades very rapidly rotate outwardly to the deployed position and are locked before continued movement of the broadhead brings the locked blades into contact with the target. The rapid outward rotation of the blades should be facilitated by low-friction rotary connections between the blades and ferrule.

SUMMARY OF THE INVENTION

The invention is an improved broadhead with expandable front pivot cutting blades where the blades are connected to the broadhead by low-friction rotary connections. The connections reduce frictional forces during outward rotation of the blades and permit locked blade deployment before the blades hit the target.

The broadhead is mounted on the lead end of an arrow fired by a crossbow or archery bow. Alternatively, the broadhead may be mounted on a spear, harpoon or like device. During flight of the broadhead, the blades are in a trailing, streamlined position to reduce aerodynamic drag so that the broadhead is similar to a field tip point and permits a more accurate shot.

The blades are mounted on the head in longitudinally extended slots by sliding and rotary connections that permit rapid rearward movement and rapid outward rotation of the blades to a locked, fully deployed position upon impact. Before impact, latches hold the blades in the streamlined position to reduce drag.

Initial impact of the blades with a target slides the blades rearwardly along the ferrule, releases the latched connections and quickly rotates the blades outwardly from the streamlined position to the outwardly extended deployed and locked position before the blades impact the target. To maximize impact, the blades must be locked in the deployed position before engagement with the target.

Rotational frictional forces exerted on the blades during outward rotation are reduced by providing a low-friction line contact rotary connection between each blade and a mounting member supporting the blade on the broadhead ferrule. The small area contacts between the blades and mounting members reduce frictional forces during outward rotation of the blade and deployment so that the blades are deployed and locked when the blades impact the target.

The mounting members are fitted in grooves to either side of blade slots in the ferrule. On impact, the mounting members and blades move rearwardly along the slots and are unlatched as the blades are rapidly rotated outwardly around the mounting members from the streamlined position to the fully deployed position. Outward rotation of the blades is facilitated by cams on the ferrule which engage follower surfaces on the blades. The blades include lock surfaces which lock the blades in the deployed position.

DESCRIPTION OF THE DRAWINGS

The improved broadhead is illustrated in the drawings where.

DESCRIPTION OF THE PREFERRED EMBODIMENTS

Figure 1:
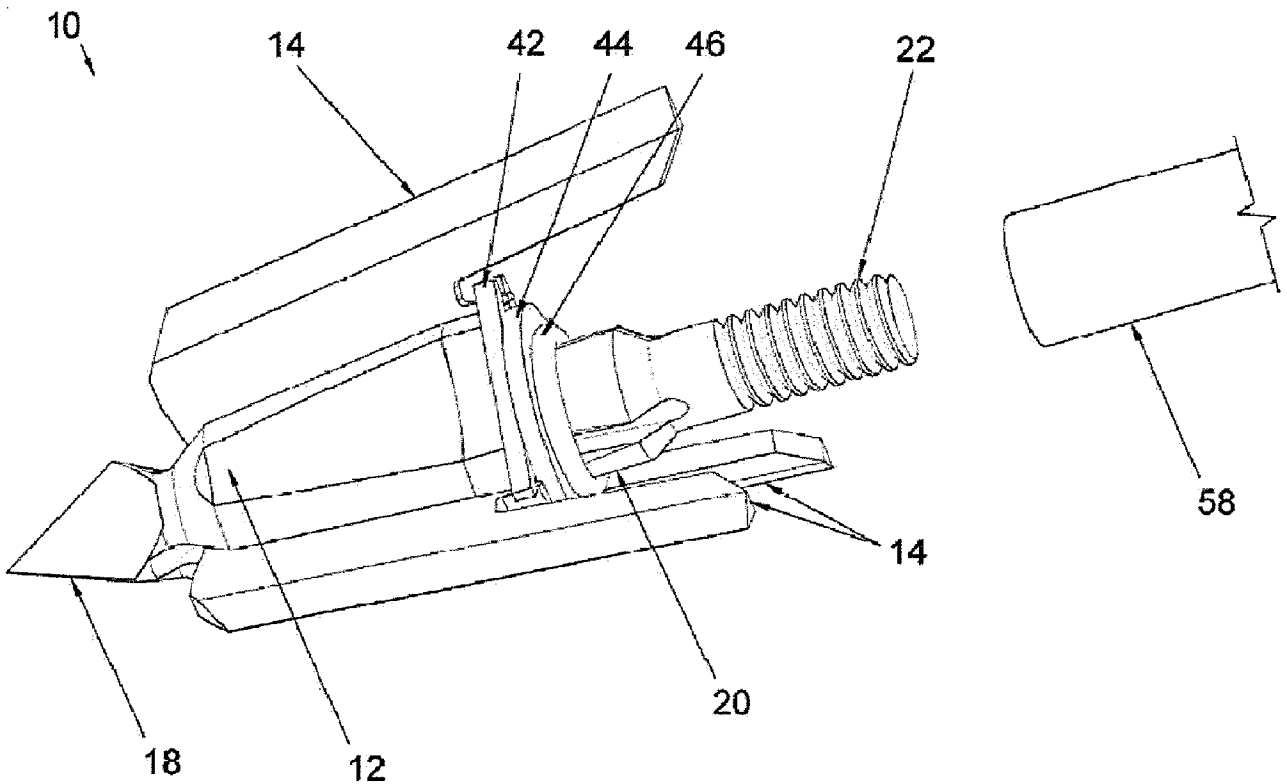
FIG. 1 is a perspective view of a broadhead with the blades retracted.
Figure 2:
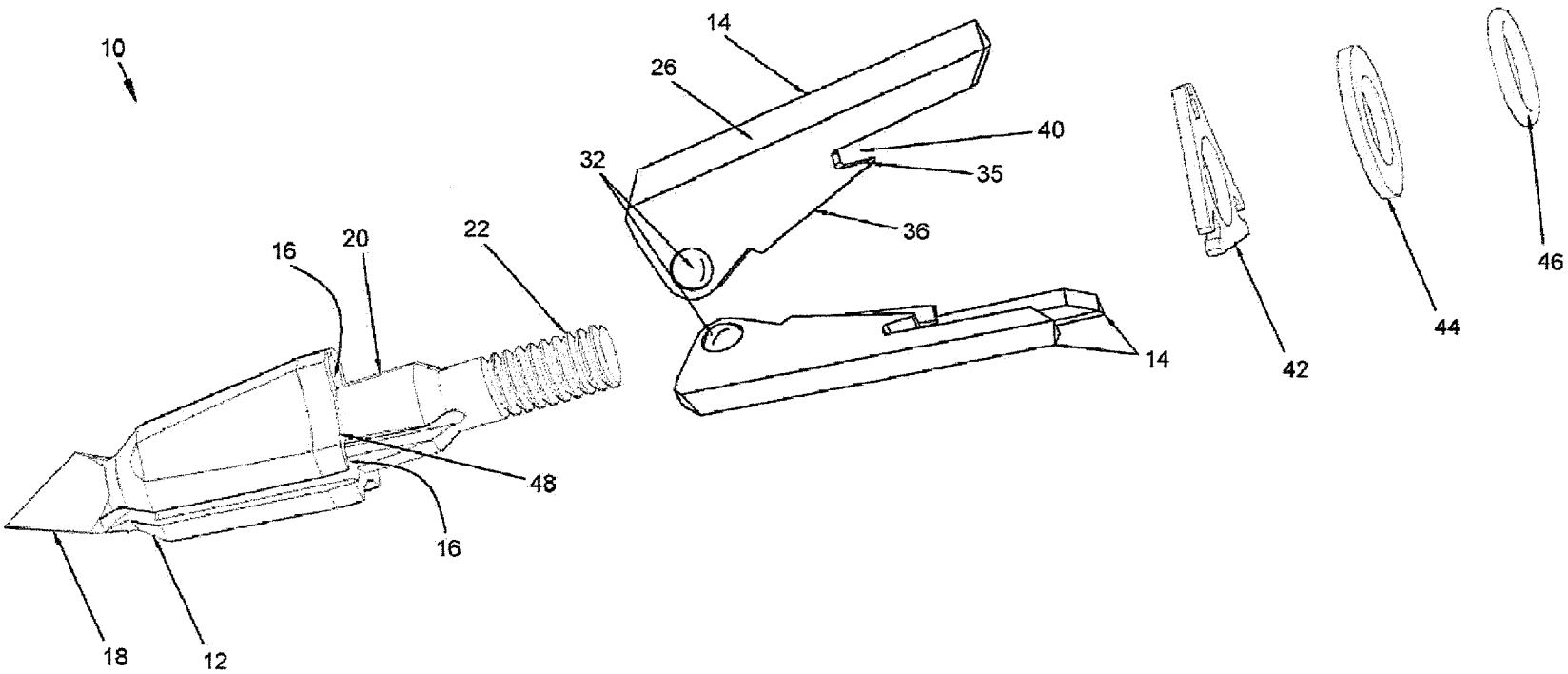
FIG. 2 is an exploded view of the broadhead shown in FIG. 1.
Figure 4:
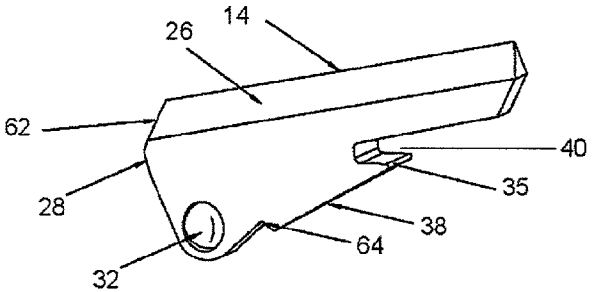
FIG. 4 illustrates the ball mounted in the blade.

Broadhead 10 includes a metal ferrule or body 12 mounted on the lead end of an arrow and three cutting blades 14 positioned in three slots 16 in ferrule 12. The slots 16 extend longitudinally and outwardly along ferrule 12 and are spaced apart 120 degrees around the ferrule. Ferrule 12 includes a trocar tip 18 on the lead end of the ferrule, an indexing shaft 20 extending from the trailing end of the ferrule and a reduced-diameter, threaded end 22 extending rearwardly from shaft 20. Ferrule 12 is preferably formed from steel.

Each blade 14 is preferably formed from uniform-thickness stainless steel. The blades have opposed parallel sides 24, an elongate arm 26 extending from the front to the rear of the blade, and an inwardly extending mounting portion 28 below the forward end of arm 26. Cylindrical hole or passage 30 extends through the front or forward end of portion 28. Mounting member 32, preferably a spherical steel ball, is positioned in hole 30. The ball may be chrome-plated. The balls 32 engage the interior surfaces of the holes 30 at low-friction rotary line contact surfaces 34, illustrated in FIG. 5. The surfaces 34 are located in the blades between blade sides 24.

Slots 16 may have a width of 0.138 inches. Blades 14 may have a thickness of 0.136 inches so that the blades have close sliding fits in the slots. Holes 30 in the blades may have a diameter of 0.0938 inches with spherical mounting members 32 having a diameter of 0.093 inches for close, low-friction rotary fits in the bores.

Figure 5:
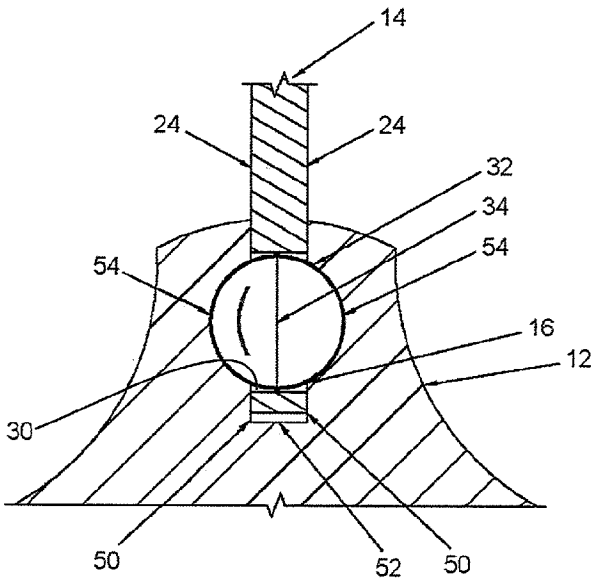
FIG. 5 is a broken-away transverse sectional view taken through the forward end of the broadhead illustrating the connection between a blade and the head.
Figure 3:
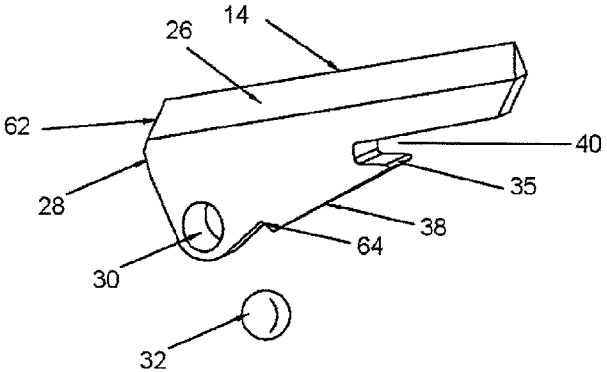
FIG. 3 illustrates one cutting blade and a metal ball which is fitted in the blade to mount the blade on the head.

The diameter of ball 32 is greater than the thickness of the arm so that, as illustrated in FIG. 5, the sides of ball 32 extend outwardly beyond blade sides 24.

The mounting portion 28 of each blade 14 has a maximum depth at the lead end of the blade, adjacent hole 30 and a minimum depth at end 35 so that edge 38, across from arm 26, slopes inwardly toward the arm from hole 30 to end 35. Latch recess 40 extends into blade 14 between end 35 and arm 26.

Broadhead 10 includes a blade latch 42, flat aluminum cam washer 44 and a resilient O-ring 46 fitted on shaft 20.

The longitudinal slots 16 are formed in ferrule 12 and extend from tip 18 to ferrule end 48. Each slot 16 has opposed, flat and parallel side walls 50 and a bottom wall 52 between the side walls. The side walls extend from the bottom wall to the outer surface of ferrule 12. Semi-circular grooves 54 are formed in side walls 50. The grooves lie on the surface of a cylindrical surface. Each groove extends along the length of the side wall from body end 48 to groove front end 56 adjacent tip 18. The portions of balls 32 extending out from blades 14 have low-friction, line contact sliding fits in grooves 54 to permit ready sliding movement of the blades along slots 16 upon impact. The blades quickly rotate out from the retracted position shown in FIGS. 1 and 6 to an extended or deployed position shown in FIG. 8 around low-friction line contact surfaces 34.

Figure 8:
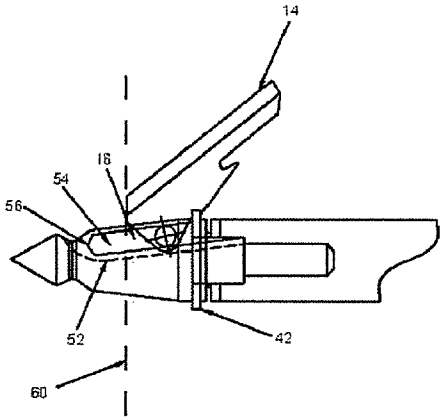
FIG. 8 is a view like FIG. 7 showing the blade fully deployed and locked prior to penetrating the target.
Figure 7:
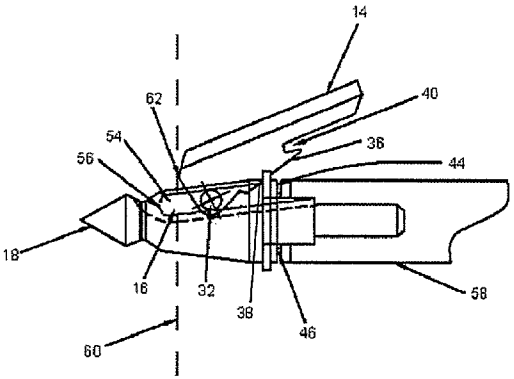
FIG. 7 is a view like FIG. 6 showing initial impact with the target and rearward and outward rotation of the blade.
Figure 6:
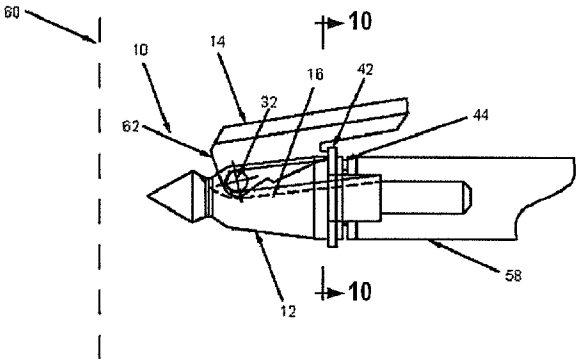
FIG. 6 is a view illustrating one blade mounted on the broadhead prior to impact with a target.

The slots 16 may be formed in ferrule 12 by first drilling cylindrical bores into the main body from ferrule end 48. The bores angle down toward the axis of the ferrule as illustrated in FIGS. 6, 7 and 8. Then, the slots 16 are milled through the bores leaving grooves 54 in side walls 50. The grooves slope inwardly from end 48 so that movement of the blades from the inner ends 56 of the grooves to outer ends 48 move the blades radially outwardly on the ferrule.

Figure 9:
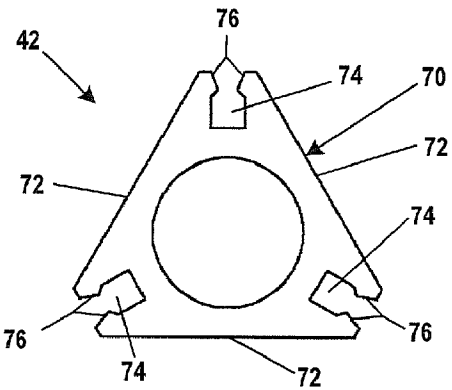
FIG. 9 illustrates a latch member.

Blade latch 42 as shown in FIG. 9 has a triangle-shaped, flat plastic body 70 having straight sides 72 and latch recesses at the corners of the body. The mouth of each recess 74 includes two inwardly extending retention projections 76. The projections 76 reduce the width of recesses 74. The outer and inner surfaces of the projections are angled to facilitate movement of the blades into and out from the recesses, as described below.

Figure 10:
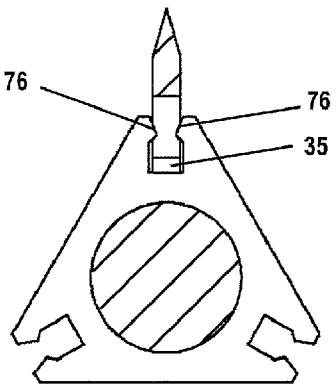
FIG. 10 is a sectional view taken along line 10-10 of FIG. 6.

Broadhead 10 is mounted on an arrow (not illustrated) by positioning blade latch 42 onto the shaft 20 with the latch abutting ferrule end 48 as illustrated in FIG. 6. Washer 44 is placed on the shaft and O-ring 46 is placed on the shaft. The cutting blades 14 are positioned in slots 16 as illustrated in FIG. 1 with balls 32 in holes 30 resting against the inner groove ends 56 illustrated in FIGS. 7 and 8. The blades are rotated to the retract position to move blade ends 35 past projections 76 and into latch recesses 74. The projections hold the blades in the retracted position. See FIG. 10.

Threaded end 22 of ferrule 12 engages the forward end of a hollow connecting member 58 mounted on the lead end of the arrow. O-ring 46 is sandwiched between the lead end of the connecting member and washer 44 to secure head 10 on the arrow. The blade latch 42 holds blades 14 in the retracted, rearwardly extending position to reduce drag and improve accuracy when the arrow is fired at a target, indicated by vertical line 60 shown in FIGS. 6, 7 and 8.

FIG. 6 illustrates broadhead 10 in flight immediately prior to hitting target 60. The blades 14 are positioned on ferrule 12 with balls 32 seated against groove ends 56. Blade latch 42 holds the blades inwardly with edges 38 engaging washer 44.

FIG. 7 illustrates broadhead 10 after initial contact of ferrule 12 with target 60. Trocar tip 18 has penetrated the target. The surface of the target has engaged from shoulders 62 on blades 14 to push the blades rearwardly and outwardly from the ferrule. The balls 32 move back along grooves 54. Edges 36 ride along lock washer 44 so that the blades are simultaneously moved rearwardly and rotated outwardly around balls 32 as illustrated in FIGS. 7 and 8. Outer rotation of blades 14 moves ends 35 past projections 76 and out from recesses 74. Projections 76 slide along the sides of the blades as the blades are moved to the locked deployed positions.

FIG. 8 illustrates blades 14 fully deployed with lock surfaces 64 engaging lock washer 44. Engagement of the blades with washer 44 locks the blades in the fully deployed position before the blades hit target 60.

During movement of blades 14 from the retracted to the extended and latched positions, the blades and mounting members 32 move rearwardly along the line sliding connections between the portions of the mounting members extending outwardly of the blades and grooves 54. At the same time, the blades rotate outwardly along rotary connections at circular line contact surfaces 34. Frictional engagement between the blades and the mounting members is reduced because of the very small area of contact at the line surfaces. Reduction of friction at the rotary connections permits the blades to rotate outwardly very quickly so that they are locked in the extended position of FIG. 8 before the outer target cutting surfaces of the blades engage the target.

What I claim as my invention is:

1. A broadhead for mounting on the lead end of an arrow or bolt, the broadhead comprising, A. a ferrule having a tip and a slot extending away from the tip, the slot having opposed side walls and a groove extending along each side wall;

B. a blade having opposed blade sides and an opening extending through the blade between said blade sides, the blade in the slot with each blade side adjacent one side wall;

C. a spherical or spheroidal mounting member in the opening in the blade, the mounting member having portions extending outwardly from the blade sides and into said grooves;

D. two sliding connections, each sliding connection between a mounting member portion and the ferrule at one of said grooves; and E. a rotary connection between the blade and the mounting member;

F. wherein when the broadhead hits a target the mounting member moves away from the tip along the sliding connections and the blade rotates outwardly around the rotary connection.

2. The broadhead as in claim 1 wherein the opening is cylindrical.

3. The broadhead as in claim 2 wherein the blade has a thickness and the rotary connection includes a bearing surface having a width less than the thickness of the blade.

4. The broadhead as in claim 3 wherein the bearing surface is a line.

5. The broadhead as in claim 4 wherein the blade includes a follower surface, the broadhead including a cam, the follower surface engaging the cam to rotate the blade outwardly during movement of the blade away from the tip.

6. A broadhead comprising a ferrule, a blade and a spherical or spheroidal mounting member; the ferrule having a tip, a first wall extending rearwardly from the tip and a first groove in the first wall; the blade having a side and an interior opening in the side; the mounting member extending into the groove and into the interior opening; a sliding connection between the ferrule and the mounting member extending along the groove; and a rotary connection between the blade and the mounting member in the interior opening; wherein when the broadhead impacts a target the blade and mounting member move rearwardly along the sliding connection and the blade rotates outwardly around the rotary connection.

7. The broadhead as in claim 6 wherein the ferrule includes a second wall, a second groove on the second wall, said walls defining a slot, said blade in said slot, and the mounting member extends into said second groove.

8. The broadhead as in claim 7 wherein said opening is cylindrical.

9. The broadhead as in claim 8 wherein the rotary connection comprises a bearing surface located equidistant between the sides of the blade.

10. The broadhead as in claim 9 wherein said bearing surface is a line.

11. The broadhead as in claim 6 including a cam engageable with the blade upon rearward movement of the blade to rotate the blade outwardly.

12. An expanding-blade broadhead comprising:

A. a ferrule having a longitudinal slot formed therein and grooves in the sides of the slot;

B. a flat blade having opposed parallel sides and a thickness, a portion of the blade in the slot, an opening extending through the thickness of the portion of the blade in the slot;

C. a spherical or spheroidal mounting member fitted in the opening, the mounting member including portions extending outwardly from the sides of the blade at the opening and into the grooves;

D. sliding connections between the mounting member portions and the grooves in the sides of the slot; and E. a rotary connection between the blade and the mounting member, the rotary connection located in the opening;

F. wherein when the broadhead hits a target the blade moves along the grooves and rotates outwardly around the mounting member.

13. The broadhead as in claim 12 wherein the opening is cylindrical.

14. The broadhead as in claim 12 wherein the rotary connection comprises a line contact bearing surface.

15. The broadhead as in claim 12 including a cam and a follower surface on the blade for rotating the blade outward on movement along the sliding connection, and a lock to hold the blade in an outward position.

16. The broadhead as in claim 12 including a latch member, a retention member on the blade, the retention member extending into a recess in the latch member to hold the blade in a retracted position.

* * * * *